US009389577B2

(12) United States Patent
Taniguchi

(10) Patent No.: US 9,389,577 B2
(45) Date of Patent: Jul. 12, 2016

(54) IMAGE FORMING APPARATUS

(71) Applicant: KYOCERA Document Solutions Inc., Osaka (JP)

(72) Inventor: Susumu Taniguchi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/629,794

(22) Filed: Feb. 24, 2015

(65) Prior Publication Data

US 2015/0239689 A1 Aug. 27, 2015

(30) Foreign Application Priority Data

Feb. 27, 2014 (JP) ..... 2014-036634

(51) Int. Cl.
*G03G 21/16* (2006.01)
*B65H 5/38* (2006.01)
*B65H 5/06* (2006.01)

(52) U.S. Cl.
CPC ..... *G03G 21/1633* (2013.01); *B65H 5/062* (2013.01); *B65H 5/38* (2013.01); *B65H 2402/441* (2013.01); *B65H 2402/45* (2013.01); *B65H 2402/52* (2013.01); *B65H 2601/321* (2013.01); *B65H 2601/324* (2013.01); *G03G 2215/0132* (2013.01); *G03G 2221/1687* (2013.01)

(58) Field of Classification Search
CPC ..... B65H 5/00; B65H 5/38; B65H 2402/31; B65H 2402/44; B65H 2402/441; B65H 2402/45; B65H 2402/52; B65H 2402/521; B65H 2402/522; B65H 2402/5221; B65H 2402/531; B65H 2601/321; B65H 2601/322; B65H 2601/324; B65H 2601/326; G03G 21/16; G03G 21/1604; G03G 21/1619; G03G 21/1623; G03G 21/1628; G03G 21/1633; G03G 21/1638; G03G 21/1642; G03G 21/1647; G03G 21/1661; G03G 21/1695; G03G 2221/16; G03G 2221/1651; G03G 2221/1654; G03G 2221/1672; G03G 2221/1675; G03G 2221/1678; G03G 2221/1687
See application file for complete search history.

(56) References Cited

U.S. PATENT DOCUMENTS 5,052,670 A * 10/1991 Makiura ..... G03G 15/234 271/127
6,848,685 B2 * 2/2005 Katsuyama ..... B41J 13/103 271/162
7,430,385 B2 * 9/2008 Yamaoka ..... G03G 15/165 399/100

(Continued)

FOREIGN PATENT DOCUMENTS

JP 2012-220546 11/2012

*Primary Examiner* — Ernesto Suarez
(74) *Attorney, Agent, or Firm* — Wenderoth, Lind & Ponack, L.L.P.

(57) ABSTRACT

An image forming apparatus includes a cover, a conveying unit, and a sheet feeding unit. The cover is provided to be able to open and close an opening of a housing. The conveying unit is disposed adjacent to an inner side of the cover. The sheet feeding unit is disposed in an inner side of the conveying unit. The cover is rotatably supported to a pair of first bearings between an opened position and a closed position of the opening. The conveying unit is rotatably supported to a pair of second bearings, which are provided inward from the first bearings, in the same direction as an opening and closing direction of the cover and is detachably provided with respect to the housing at a position at which the conveying unit has rotated in the opening direction of the cover by a predetermined angle.

2 Claims, 15 Drawing Sheets

(56) References Cited

U.S. PATENT DOCUMENTS 7,865,110 B2 * 1/2011 Yamazaki ..... G03G 21/1628 399/110
7,917,062 B2 * 3/2011 Shin ..... G03G 15/657 399/124
8,315,539 B2 * 11/2012 Uehara ..... G03G 21/1638 399/124
8,342,504 B2 * 1/2013 Yamamoto ..... B65H 1/04 271/127
8,401,426 B2 * 3/2013 Nieda ..... E05C 19/02 399/114
8,811,857 B2 * 8/2014 Fukunaga ..... B65H 5/00 271/264
2010/0098473 A1 * 4/2010 Hosoi ..... B65H 5/38 399/400

* cited by examiner

IMAGE FORMING APPARATUS

CROSS-REFERENCE TO RELATED APPLICATION

This application is based upon and claims the benefit of priority from Japanese Patent Application No. 2014-036634 filed on Feb. 27, 2014, the entire contents of which are incorporated herein by reference.

BACKGROUND

The technology of the present disclosure relates to an image forming apparatus provided with a conveying unit that conveys sheets while directing a longitudinal direction of an apparatus body upward.

Conventionally, there has been known an image forming apparatus that performs an image formation process while conveying sheets along a conveyance path extending from a sheet feeding unit while directing a longitudinal direction of an apparatus body upward.

An image forming apparatus having a vertical conveyance type conveyance path, for example, is provided with a conveying unit and an outer cover that covers an outer surface side of the conveying unit. At an inner surface side of the conveying unit, a conveyance path directed upward from a sheet feeding unit is formed by a resist roller and the like, and between the outer surface side of the conveying unit and the outer cover, an approximately C-shaped conveyance path for inversion through which a sheet with reversed front and back passes. In this image forming apparatus, the outer cover and the conveying unit are supported so as to rotate about the same rotation point.

SUMMARY

An image forming apparatus according to one aspect of the present disclosure includes a cover, a conveying unit, and a sheet feeding unit. The cover is provided to be able to open and close an opening formed in a housing. The conveying unit is disposed adjacent to an inner side of the cover and forms a sheet conveyance path in the housing. The sheet feeding unit is disposed in an inner side of the conveying unit and feeds a sheet toward the conveyance path. The cover is rotatably supported to a pair of two first bearings between an opened position and a closed position of the opening. The conveying unit is rotatably supported to a pair of two second bearings, which are provided inward from the first bearings, in the same direction as an opening and closing direction of the cover and is detachably provided with respect to the housing at a position at which the conveying unit has rotated in the opening direction of the cover by a predetermined angle.

DETAILED DESCRIPTION

Hereinafter, an image forming apparatus according to the present embodiment will now be described with reference to the accompanying drawings.

Figure 1:
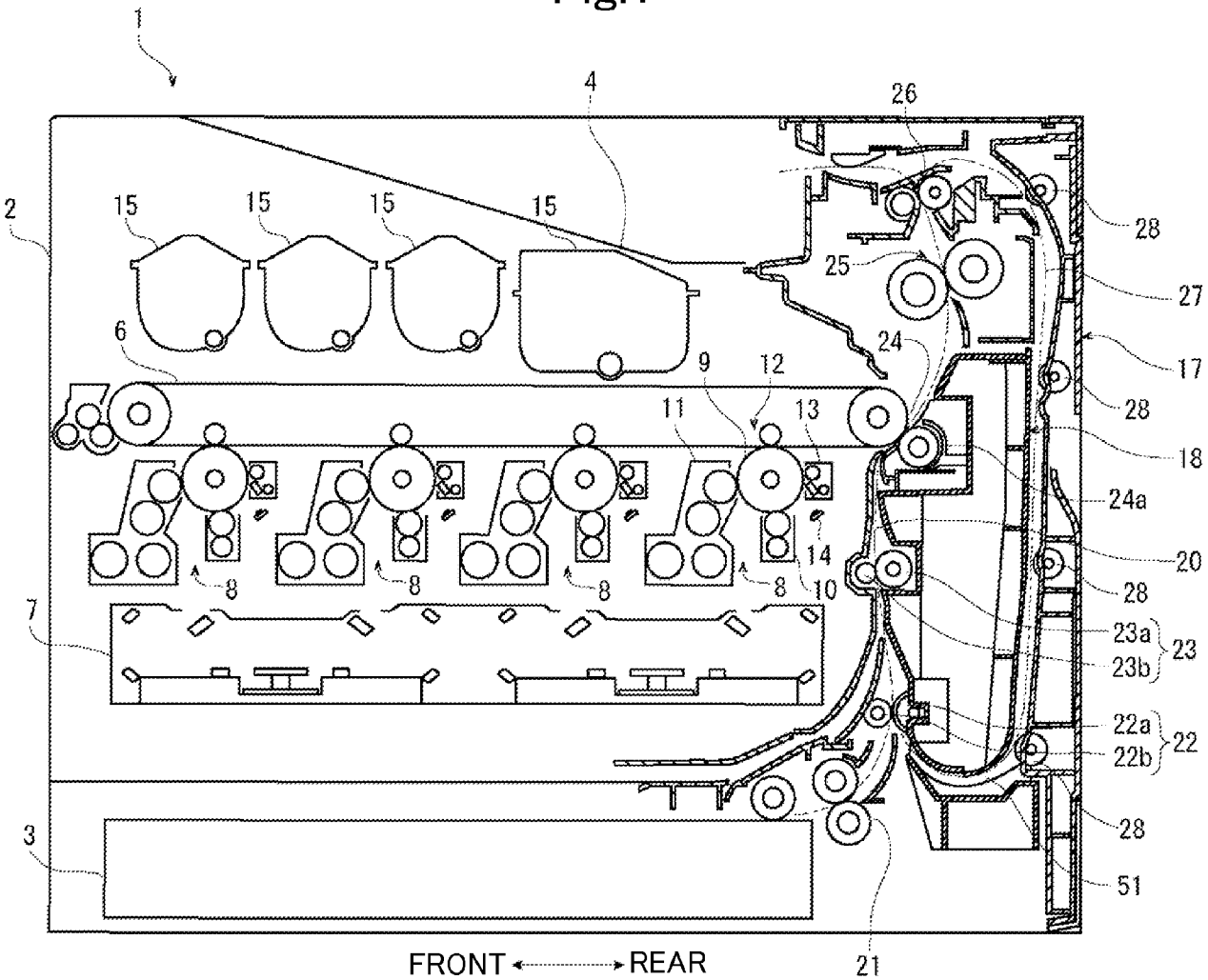
FIG. 1 is a schematic view illustrating the outline of a configuration of a color printer according to the present embodiment.
Figure 2:
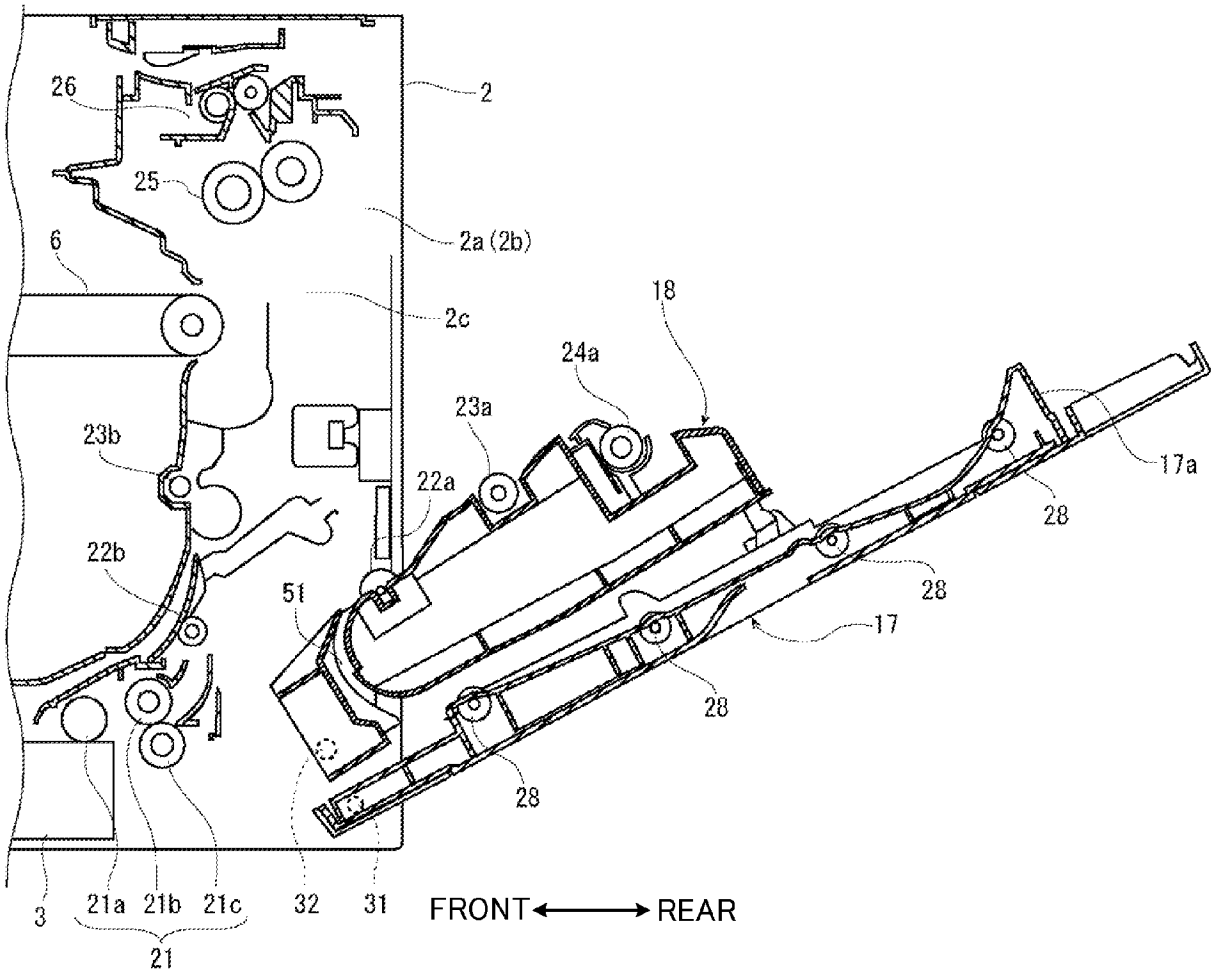
FIG. 2 is a side view illustrating an opened state of an outer cover and a conveying unit in a color printer according to the present embodiment.

Firstly, with reference to FIG. 1 and FIG. 2, an entire configuration of a color printer 1 as an image forming apparatus will be described. FIG. 1 is a schematic view illustrating the outline of a configuration of a color printer according to the present embodiment, and FIG. 2 is a side view illustrating the state in which a conveying unit and an outer cover have been opened in the color printer. In addition, in the following description, in FIG. 1, a left side is defined as a front (fore) side of the color printer 1, and a direction perpendicular to a front and rear direction is defined as a right and left direction when viewed from the front.

As illustrated in FIG. 1, the color printer 1 is provided with a box-shaped housing 2, and a sheet feeding cassette 3 accommodating sheets (not illustrated) as recording mediums is provided in a lower portion of the housing 2. A sheet discharge tray 4 is provided at an upper portion of the housing 2. As illustrated in FIG. 2, the housing 2 is formed at a back side thereof with an opening 2*c* between left and right side plates 2*a* and 2*b*. The opening 2*c* is openable and closable in an outer cover (a cover) 17.

In the housing 2, an intermediate transfer belt 6 serving as an image carrying member is installed between a plurality of rollers, an exposure unit 7 including a laser scanning unit (LSU) is disposed below the intermediate transfer belt 6, and four image forming units 8 are provided for each toner color along a lower portion of the intermediate transfer belt 6.

A photosensitive drum 9 is rotatably provided to each image forming unit 8. A charger 10, a developing unit 11, a primary transfer unit 12 formed between the intermediate transfer belt 6 and a primary transfer roller, a cleaning device 13, and an electricity removing unit 14 are provided around the photosensitive drum 9 in sequence of a primary transfer process. Four toner containers 15 corresponding to each of the image forming units 8 are provided above the developing unit 11 for each toner color.

A conveying unit 18 is disposed adjacent to an inner side of the outer cover 17 at a back side of the interior of the housing 2. A sheet conveyance path 20 extending while directing a longitudinal direction upward from the sheet feeding cassette 3 toward the sheet discharge tray 4 is formed on the front surface of the conveying unit 18. In the conveyance path 20, a sheet feeding unit 21 having a feed roller 21*a* and a sheet feeding roller 21*b* and a separation roller 21*c* disposed to oppose to each other, an upstream side conveying unit 22 having conveying roller pairs 22*a* and 22*b*, a downstream side conveying unit 23 having resist roller pairs 23*a* and 23*b*, a second transfer unit 24 formed between one end (an upper right end in the drawing) of the intermediate transfer belt 6 and a second transfer roller 24*a*, a fixing device 25, and a sheet discharge unit 26 are provided from an upstream side to a downstream side.

Furthermore, an inversion path 27 for duplex printing branched from the conveyance path 20 is formed between a rear surface of the conveying unit 18 and a front surface of the outer cover 17. The inversion path 27 extends while directing the longitudinal direction upward from the downstream of the discharge unit 26 toward between the sheet feeding unit 21 and the upstream side conveying unit 22 and is formed to have an approximately C-shape. In the inversion path 27, four conveying rollers 28 are disposed from the upstream side toward the downstream side.

Next, an image formation operation of the printer 1 having such a configuration will be described. When the printer 1 is powered on, various parameters are initialized and initial setting such as temperature setting of the fixing device 25 is performed. Then, image data is inputted from a computer and the like connected to the printer 1, and when a print start instruction is issued, the image forming operation is performed as follows.

Firstly, after the surface of the photosensitive drum 9 is charged by the charger 10, exposure corresponding to the image data is performed for the photosensitive drum 9 by laser light from the exposure unit 7, so that an electrostatic latent image is formed on the surface of the photosensitive drum 9. The electrostatic latent image is developed into a toner image of a corresponding color in the developing unit 11. The toner image is primarily transferred to the surface of the intermediate transfer belt 6 in the primary transfer unit 12. The aforementioned operations are sequentially repeated by each image forming unit 8, so that a full color toner image is formed on the intermediate transfer belt 6. In addition, toner and charge remaining on the photosensitive drum 9 are removed by the cleaning device 13 and the electricity removing unit 14.

On the other hand, a sheet taken out from the sheet feeding cassette 3 or a manual feeding tray (not illustrated) by the sheet feeding unit 21 is conveyed to the second transfer unit 24 by the upstream side conveying unit 22 and the downstream side conveying unit 23 at the same timing as that of the aforementioned image forming operation, so that the full color toner image on the intermediate transfer belt 6 is secondarily transferred to a sheet in the second transfer unit 24. The sheet with the secondarily transferred toner image is conveyed to the downstream side in the conveyance path 20 and enters into the fixing device 25, so that the toner image is fixed to the sheet in the fixing device 25. The sheet with the fixed toner image is discharged to the sheet discharge tray 4 from the sheet discharge unit 26.

In the case of duplex printing, the sheet with the fixed toner image in the fixing device 25 passes through the sheet discharge unit 26 and is then conveyed to the inversion path 27, so that the front and back of the sheet are reversed. The sheet with the reversed front and back is conveyed to the conveyance path 20 again through the inversion path 27 by the conveying rollers 28, an image is formed on an opposite surface of the sheet similarly to the above, and then the sheet is discharged from the sheet discharge unit 26 to the sheet discharge tray 4.

As illustrated in FIG. 2, left and right bearings (first bearings) 31, to which the outer cover 17 is pivotally supported, are coaxially formed behind the sheet feeding unit at lower end portions of inner surfaces of the left and right side plates 2*a* and 2*b* of the housing 2. Left and right bearings (second bearings) 32, to which the conveying unit 18 is pivotally supported, are coaxially formed at obliquely upper front sides of the left and right bearings 31 of the outer cover 17. The outer cover 17 is pivotally supported so as to be rotatable by the bearings 31 between an approximately vertical closed position and an opened position opened from the closed position by a predetermined angle. The conveying unit 18 is pivotally supported so as to be rotatable in the same direction as that of the outer cover 17 by the bearings 32, and is detachable at a predetermined position slightly rotated in a closed direction from the opened position.

Figure 3:
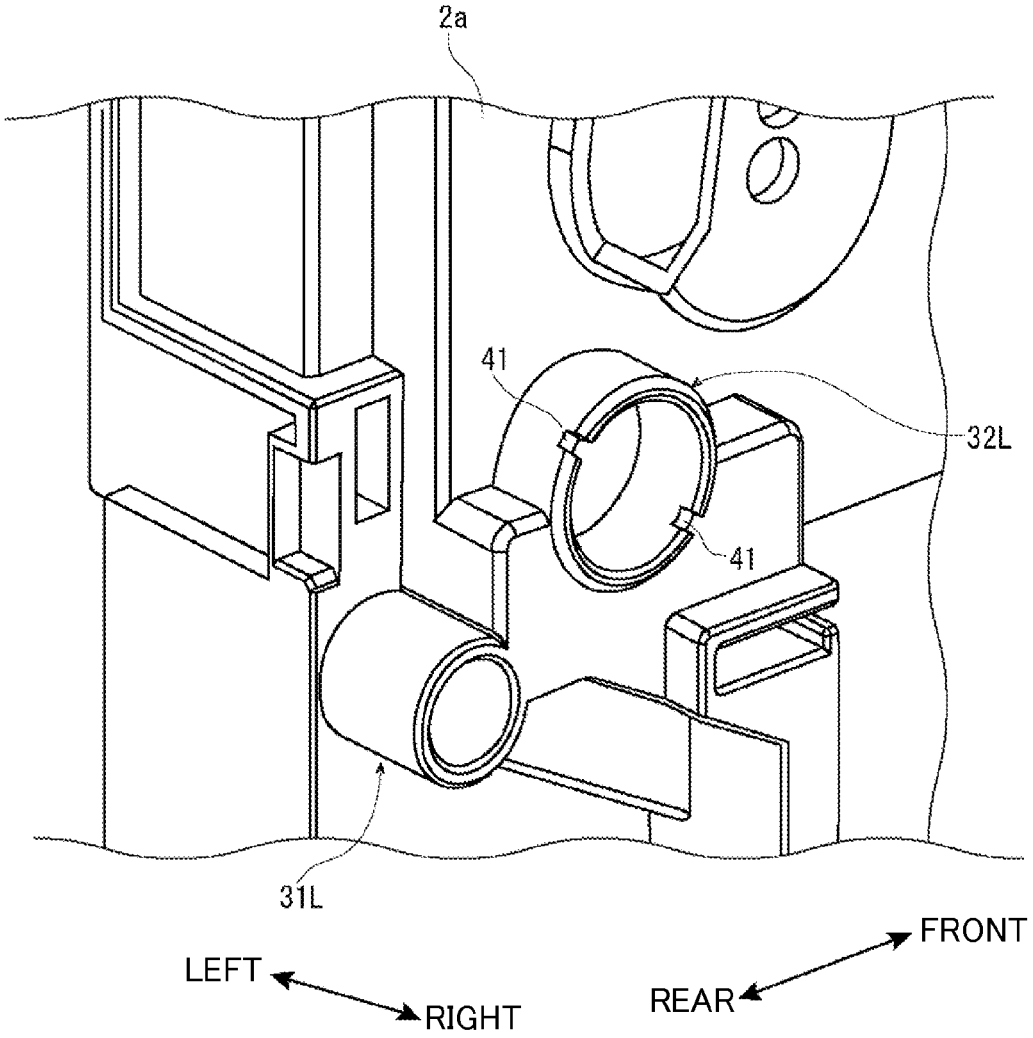
FIG. 3 is a perspective view illustrating left bearings of an outer cover and a conveying unit in a color printer according to the present embodiment.
Figure 4:
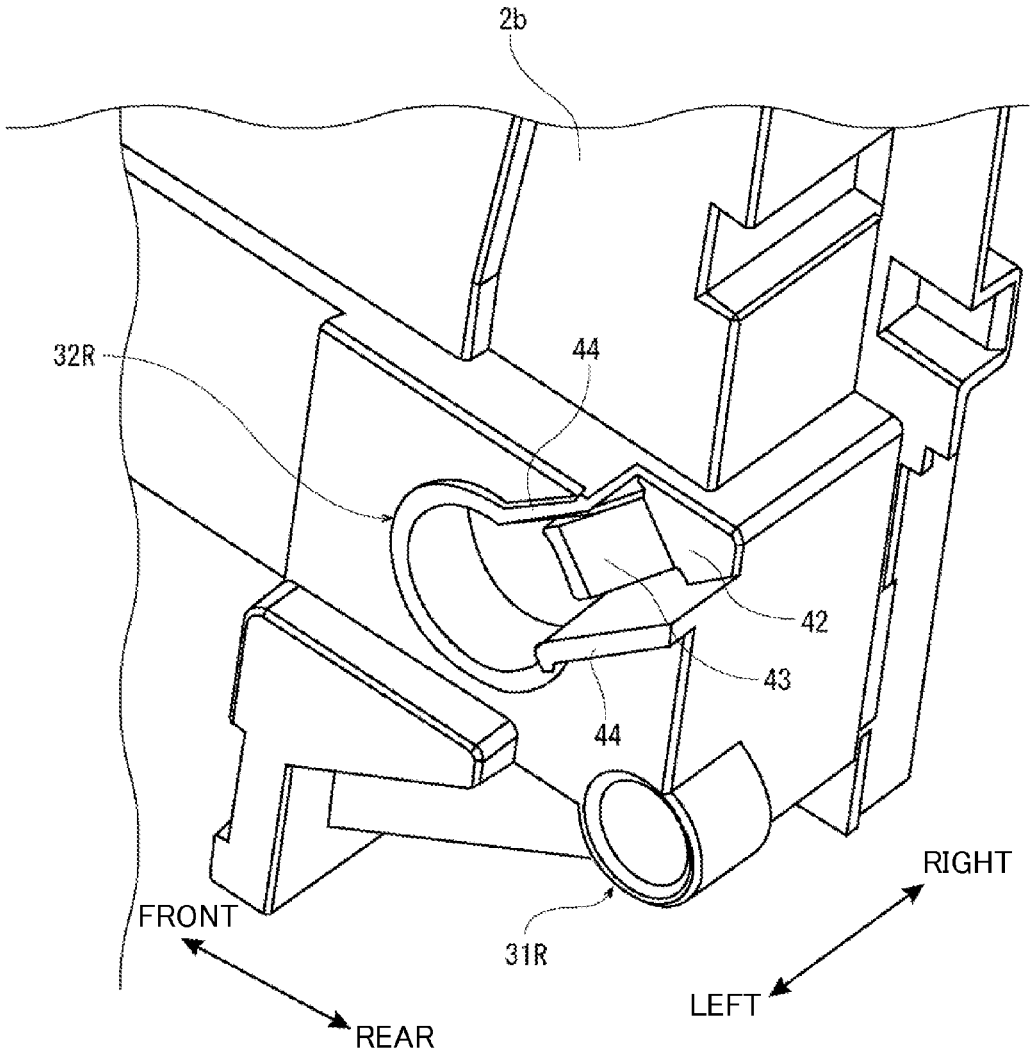
FIG. 4 is a perspective view illustrating right bearings of an outer cover and a conveying unit in a color printer according to the present embodiment.

With reference to FIG. 3 and FIG. 4, left and right bearings 31L and 31R of the outer cover 17 and left and right bearings 32L and 32R of the conveying unit 18 will be described. FIG. 3 is a perspective view illustrating the lower end portion of an inner surface of the left side plate and FIG. 4 is a perspective view illustrating the lower end portion of an inner surface of the right side plate.

As illustrated in FIG. 3, the left bearing 31L of the outer cover 17 is formed at the lower end portion of an inner surface of the left side plate 2*a* and has a cylindrical boss shape. The left bearing 32L of the conveying unit 18 is formed at an obliquely upper front side of the left bearing 31L of the outer cover 17 and has a cylindrical boss shape. Shallow slits 41 axially extending are formed diagonally to a distal end surface of the left bearing 32L. The slits 41 are formed to correspond to detachable positions of the conveying unit 18.

As illustrated in FIG. 4, the right bearing 31R of the outer cover 17 is formed at the lower end portion of an inner surface of the right side plate 2*b* and has a cylindrical boss shape. The right bearing 32R of the conveying unit 18 is formed at an obliquely upper front side of the right bearing 31R of the outer cover 17 and has a concave shape of a bottomed cylindrical shape with a predetermined depth. A rail part 42 communicates with a side surface of the right bearing 32R at an angle corresponding to the detachable position of the conveying unit 18. The rail part 42 has a rectangular section, and has the same depth as that of the right bearing 32R and a width narrower than a diameter of the right bearing 32R. The rail part 42 is provided at the bottom portion thereof with a stopper piece 43 obtained by cutting up, as a start point, a side slightly near the right bearing 32R from an entrance side (an opposite side of the right bearing 32R) of the rail part 42. The stopper piece 43 is erected obliquely upward toward the right bearing 32R from the entrance side so as to block a passage of the rail part 42, and has a distal end surface curved in a concave shape. Furthermore, the stopper piece 43 is rotatable about a side of the entrance side of the rail part 42, and is elastically deformed to level with the bottom surface of the right bearing 32R when predetermined force is applied thereto. At both side edges of the rail part 42, wall portions 44 are vertically installed along the longitudinal direction.

Figure 5:
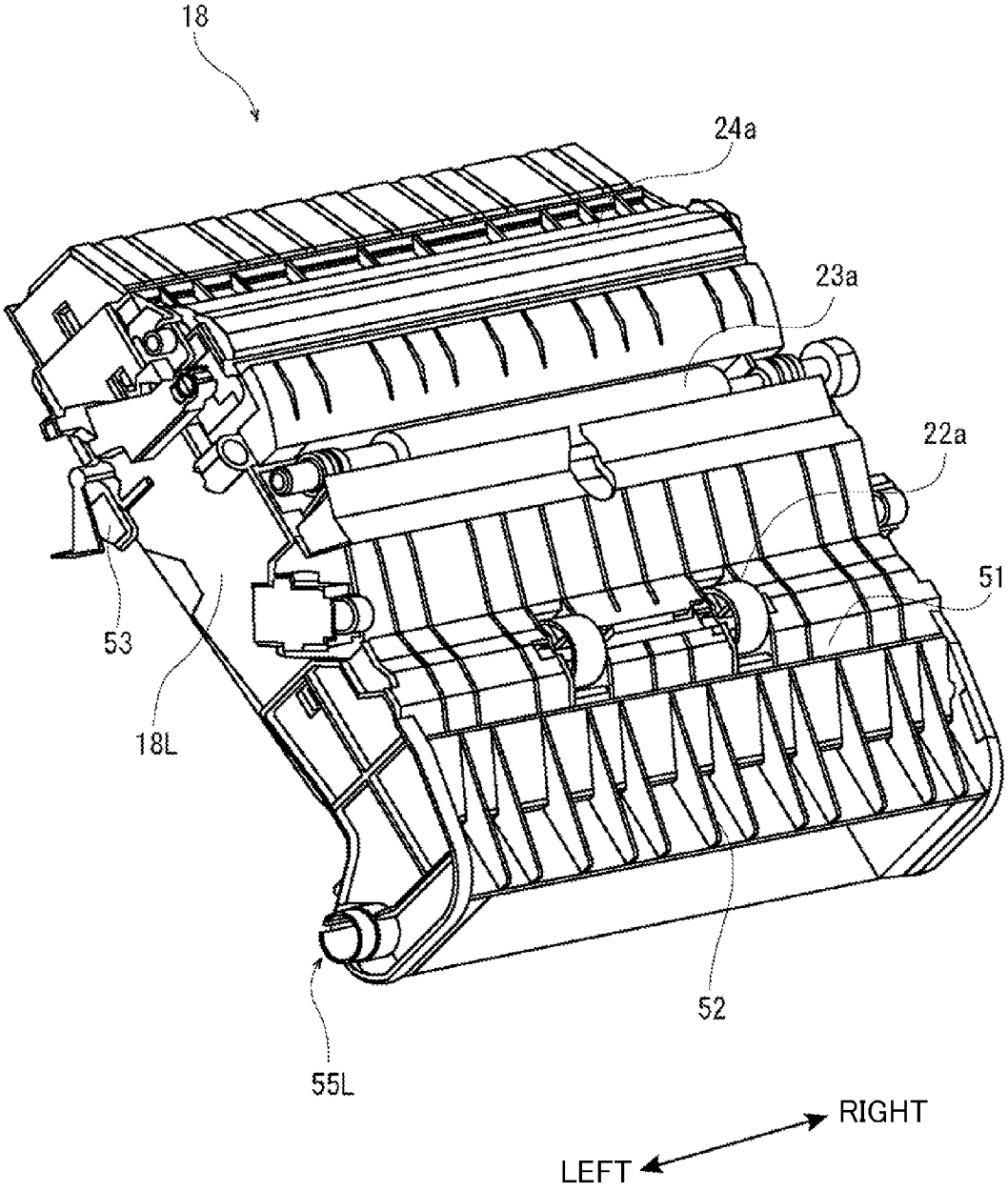
FIG. 5 is a perspective view of a conveying unit of a color printer according to the present embodiment when viewed from the left front side.
Figure 7:
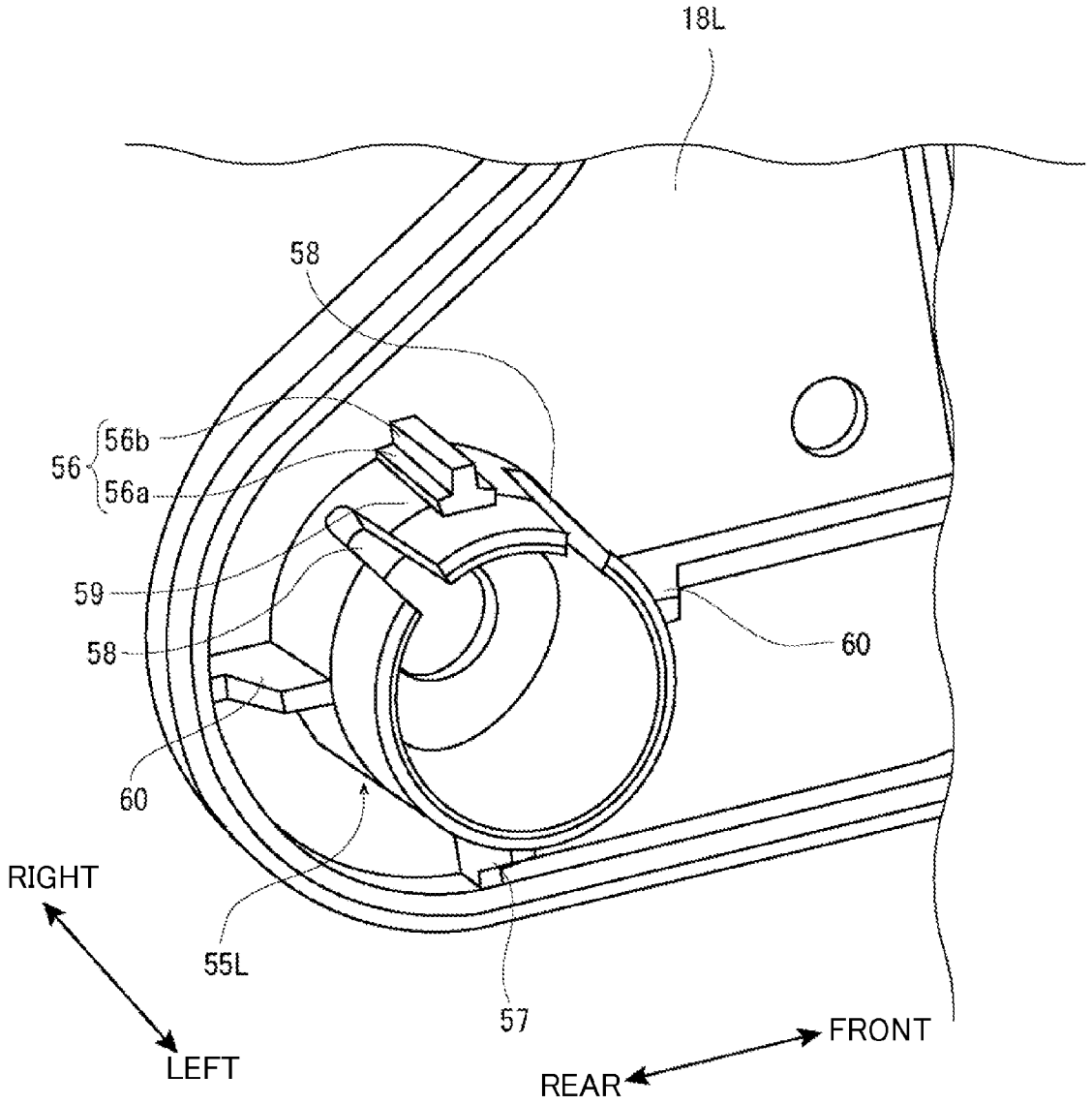
FIG. 7 is a perspective view illustrating a left spindle of a conveying unit of a color printer according to the present embodiment.
Figure 8:
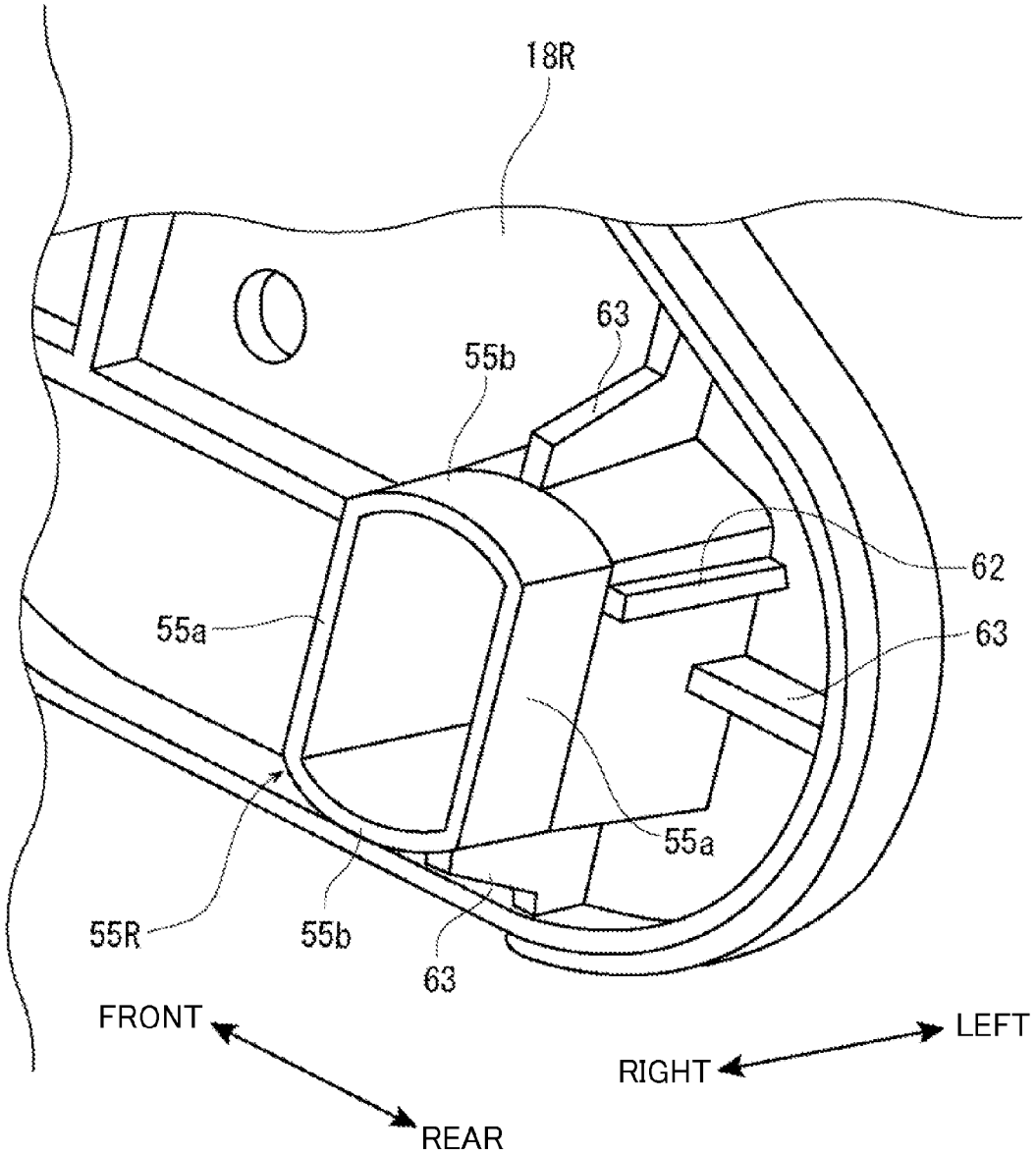
FIG. 8 is a perspective view illustrating a right spindle of a conveying unit of a color printer according to the present embodiment.

Next, the outer cover 17 and the conveying unit 18 will be described with reference to FIG. 2 and FIG. 5 to FIG. 8 and the like. FIG. 5 is a perspective view of the conveying unit when viewed from the left front side, FIG. 6 is a perspective view of the conveying unit when viewed from the right front side, FIG. 7 is a perspective view illustrating a left spindle of the conveying unit, and FIG. 8 is a perspective view illustrating a right spindle of the conveying unit.

As illustrated in FIG. 2, the outer cover 17 is a rectangular flat plate-shaped member. The outer cover 17 is provided on the front surface thereof with a support frame 17*a*. The support frame 17*a* has an approximately flat rectangular parallelepiped shape in a front and rear direction, and the front surface is curved from an upper end in a rear downward direction so as to extend nearly in a linear shape. The conveying rollers 28 are rotatably supported to the front surface of the support frame 17*a* at a predetermined interval in the longitudinal direction, and the inversion path 27 is formed between the front surface of the support frame 17*a* and the back surface of the conveying unit 18. Spindles (not illustrated) pivotally supported by the left and right bearings 31L and 31R are coaxially formed at the lower end portions of the left and right side surfaces of the outer cover 17.

Figure 6:
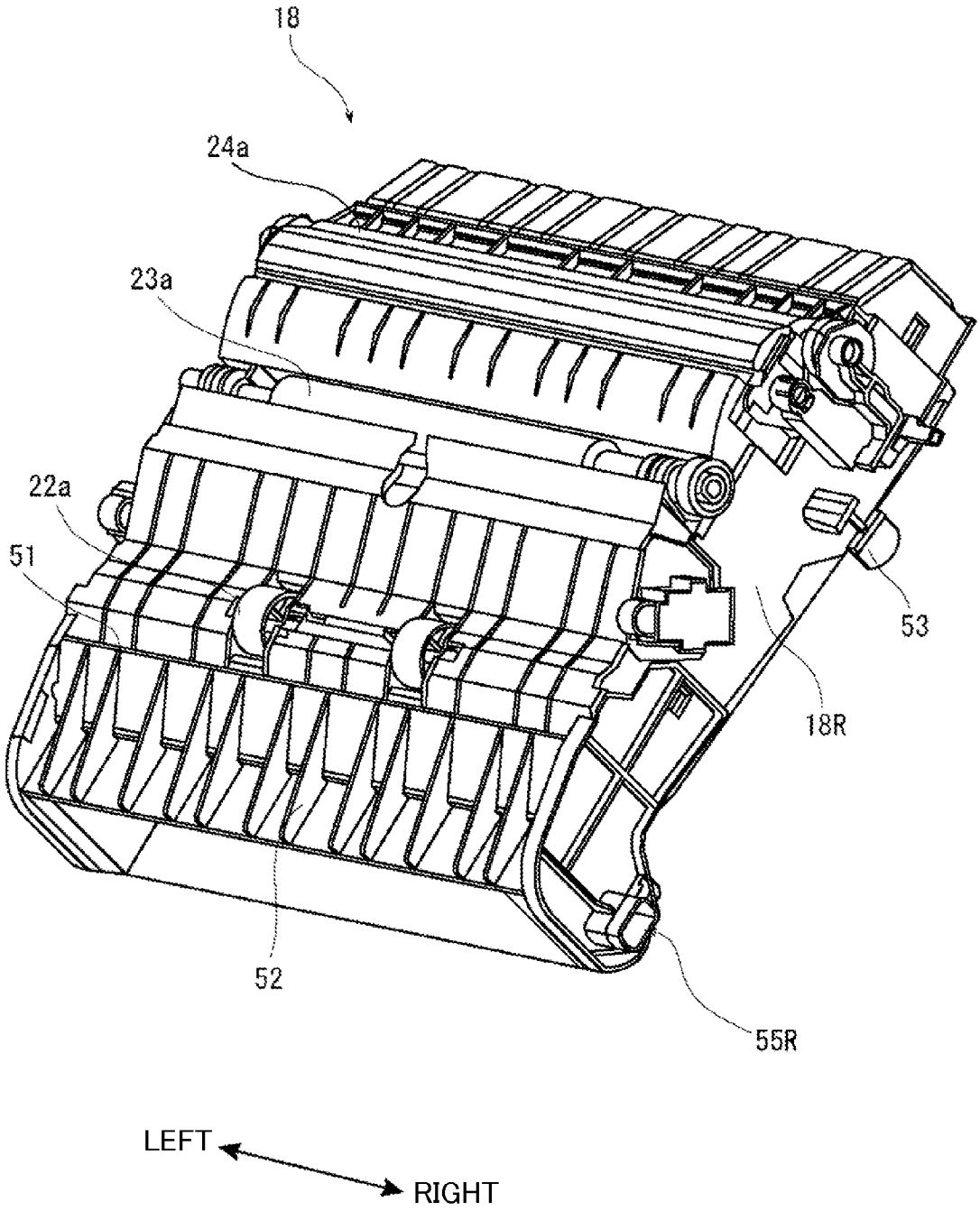
FIG. 6 is a perspective view of a conveying unit of a color printer according to the present embodiment when viewed from the right front side.

As illustrated in FIG. 5 and FIG. 6, the conveying unit 18 is a vertically long rectangular parallelepiped box-shaped member flat in the front and rear direction. At a lower portion of the conveying unit 18, a curved path 51 (see FIG. 1 and FIG. 2) curved to be convex downward and passing through from the back surface to the front surface is formed.

The conveying unit 18 is formed at the front surface thereof with a plurality of ribs 52 longitudinally extending at a predetermined interval, and the front surface forms one surface of the conveyance path 20 that longitudinally conveys sheets along the ribs 52. Furthermore, the conveying rollers 22*a* of one of the conveying roller pairs are rotatably supported to the front surface at positions slightly lower than the center of the vertical direction. Above the conveying rollers 22*a*, the resist rollers 23*a* of one of the resist roller pairs are rotatably supported. Moreover, above the resist rollers 23*a*, the transfer roller 24*a* is rotatably supported. The conveying unit 18 is also provided at the back surface thereof with a plurality of ribs longitudinally extending at a predetermined interval, and the back surface forms one surface of the inversion path 27 that longitudinally conveys sheets to the curved path 51 along the ribs.

The conveying unit 18 is provided at the left and right upper sides 18L and 18R thereof with hook parts 53 engaging with the outer cover 17. The hook parts 53 are allowed to engage with the outer cover 17, so that the outer cover 17 and the conveying unit 18 rotate together with each other. Short extension parts extending rearward are formed at the lower end portions of left and right sides 18L and 18R. On the outer surfaces of the left and right extension parts, a left spindle (the other one of the second spindles) 55L pivotally supported to the left bearing 32L and a right spindle (one of the second spindles) 55R pivotally supported to the right bearing 32R are coaxially formed.

As illustrated in FIG. 7, the left spindle 55L has a cylindrical boss shape protruding in the left direction. A first engaging protrusion 56 and a second engaging protrusion radially extending are formed diagonally to the outer peripheral surface of the left spindle 55L. The first engaging protrusion 56 and the second engaging protrusion 57 are formed to correspond to the detachable positions of the conveying unit 18. The first engaging protrusion 56 and the second engaging protrusion 57 extend to a height exceeding the center of the left spindle 55L in the height direction. The first engaging protrusion 56 has a convex shape and widths of two steps, and has a wide pedestal portion 56*a* and a narrow engaging portion 56*b* provided at the center of the pedestal portion 56*a*. At both sides of the first engaging protrusion 56 in the circumferential direction, two slits 58 axially extending from a distal end surface of the left spindle 55L to a position near a base end are formed, and an elastically deformable engaging piece 59 is formed between the two slits 58. The second engaging protrusion 57 has a uniform width and is inclined such that a height is reduced from the base end to the distal end surface.

Moreover, on the outer peripheral surface of the left spindle 55L, ribs 60 radially extending are formed at diagonal positions at which a center angle has been shifted by 90° with respect to the first engaging protrusion 56 and the second engaging protrusion 57. Each rib 60 extends from the base end of the left spindle 55L to an approximately the center height of the left spindle 55L in the height direction.

As illustrated in FIG. 8, the right spindle 55R has a box shape in which a planar shape protruding in the right direction is an oval shape, and has opposing parallel flat plate portions 55*a* and opposing curved portions 55*b*. A length of the right spindle 55R in the transversal direction is equal to a width of the rail part 42 communicating with the right bearing 32R, and a length of the right spindle 55R in the longitudinal direction is formed to be equal to an inner diameter of the right bearing 32R. A stopper protrusion 62 protruding from a side surface in a direction approximately perpendicular to the side surface is formed at one of the flat plate portions 55*a* from the base end to an approximately the center in the height direction. Furthermore, each of the flat plate portion 55*a* and the opposing curved portion 55*b* is provided on the outer peripheral surface thereof with ribs 63 protruding outward. A direction of the right spindle 55R in the longitudinal direction is formed to correspond to the rail part 42 communicating with the right bearing 32R at the detachable position of the conveying unit 18.

Figure 9:
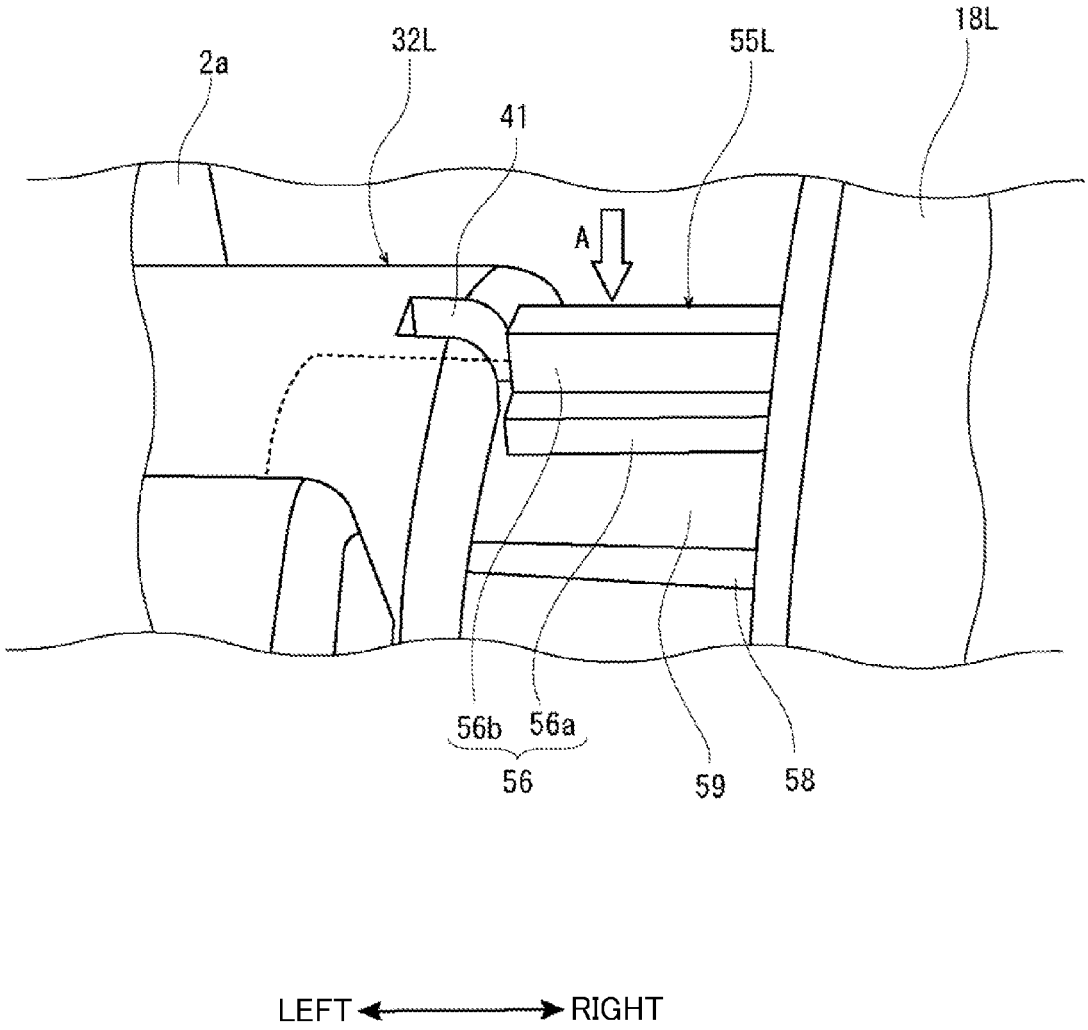
FIG. 9 is a perspective view illustrating a state in which a left spindle of a conveying unit has been pivotally supported to a bearing in a color printer according to the present embodiment.
Figure 10:
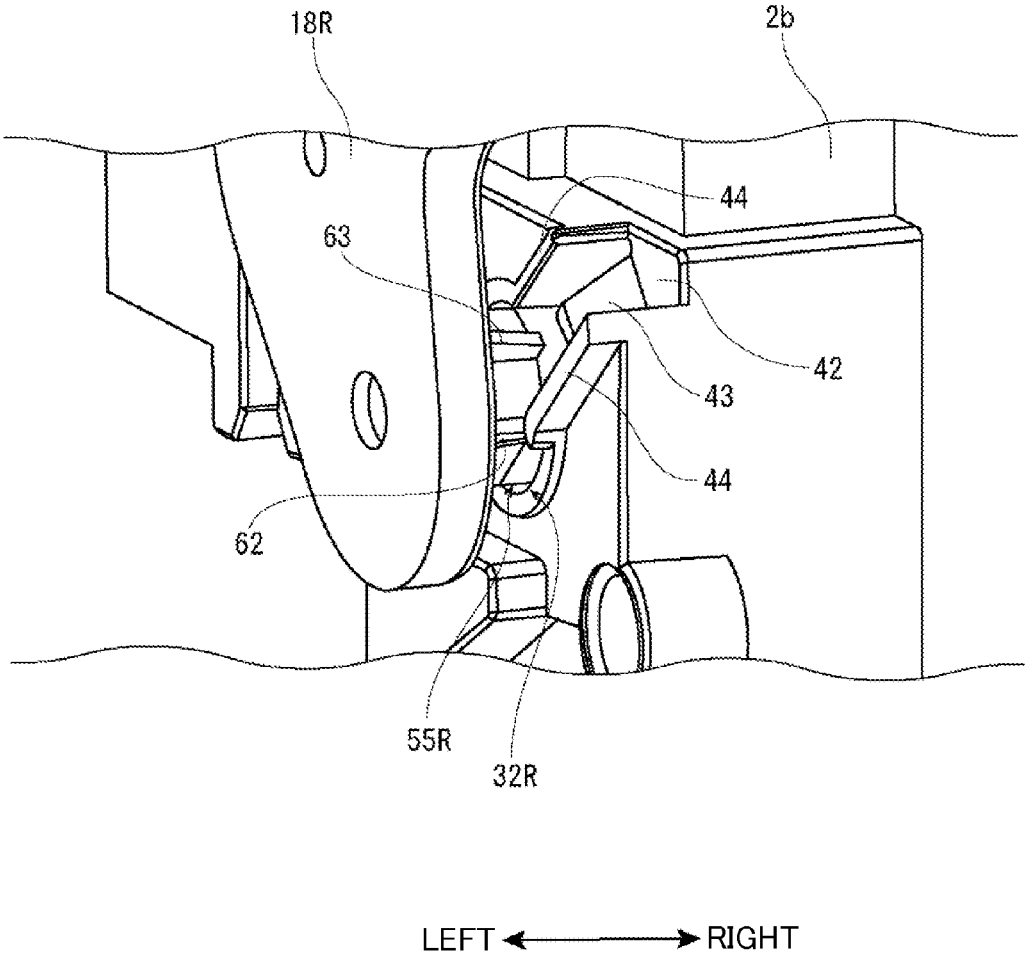
FIG. 10 is a perspective view illustrating a state in which a right spindle of a conveying unit has been pivotally supported to a bearing in a color printer according to the present embodiment.

With reference to FIG. 9 and FIG. 10, a description will be provided for the state in which the outer cover 17 and the conveying unit 18 having the aforementioned configurations have been mounted in the housing 2. FIG. 9 is a perspective view illustrating the state in which the left spindle of the conveying unit has been fitted into the left bearing, and FIG. 10 is a perspective view illustrating the state in which the right spindle of the conveying unit has been fitted into the right bearing.

In the outer cover 17, the left and right spindles are pivotally supported to the left and right bearings 31L and 31R of the housing 2, respectively, and rotate between a closed position and an opened position. Furthermore, in the opened position, rotation from the opened position to the closed position is restrained by a stopper (not illustrated).

In the conveying unit 18, the left and right spindles 55L and 55R are pivotally supported to the left and right bearings 32L and 32R of the housing 2, respectively. As illustrated in FIG. 9, a further distal end portion of the left spindle 55L, than the first engaging protrusion 56 and the second engaging protrusion 57, is rotatably fitted into the left bearing 32L, and an end surface of the pedestal portion 56*a* of the first engaging protrusion 56 and an end surface of the second engaging protrusion 57 (not illustrated in FIG. 9) abut on an end surface of the left bearing 32L. That is, in this state, the first engaging protrusion 56 and the second engaging protrusion 57 are not fitted into the slits 41 of the left bearing 32L.

As illustrated in FIG. 10, a distal end portion of the right spindle 55R, other than the stopper protrusion 62 and the rib 63, is rotatably fitted into the right bearing 32R. The stopper piece 43 formed in the rail part 42 is obliquely inclined upward toward the right bearing 32R, so that a distal end of the stopper piece 43 abuts on a side surface of the right spindle 55R. In this state, since a height, at which the stopper piece 43 and the right spindle 55R overlap each other in the height direction of the right spindle 55R, is relatively high, entrance of the right spindle 55R into the rail part 42 is prevented by the stopper piece 43.

Figure 11:
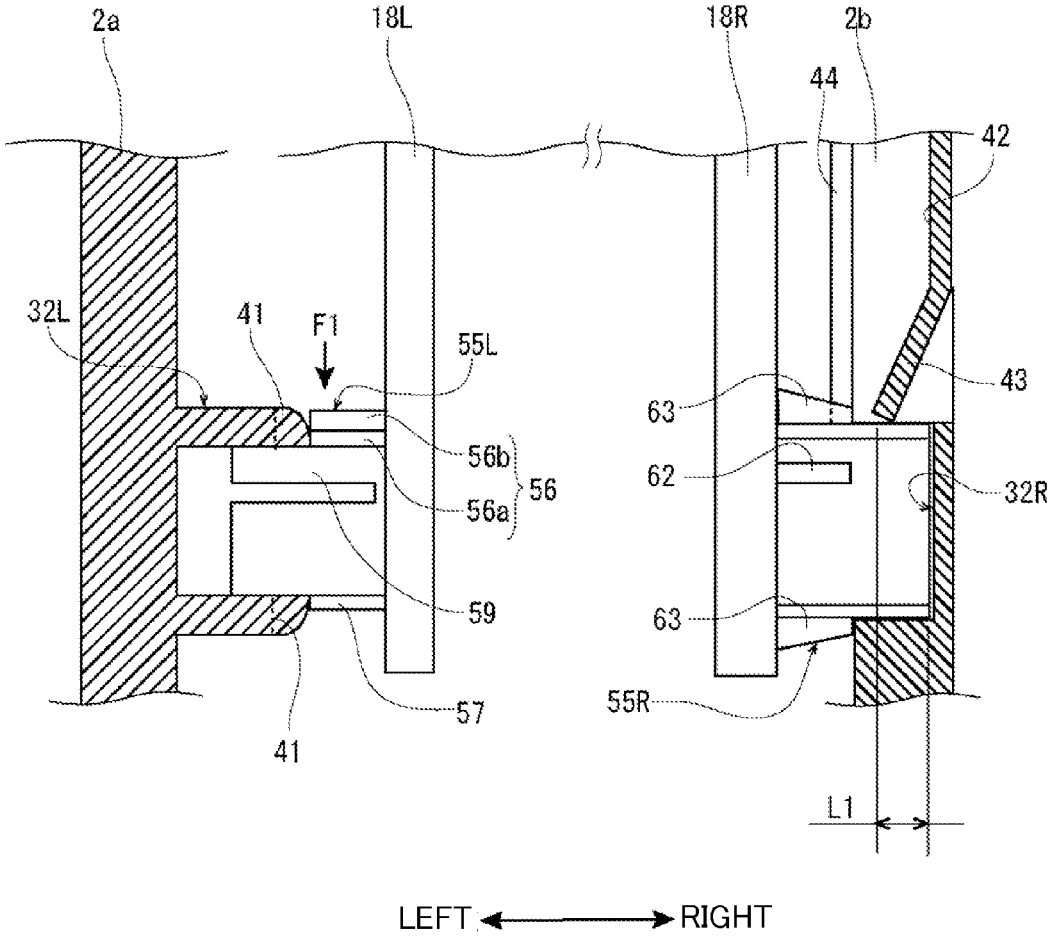
FIG. 11 is a view schematically illustrating a detachment process (at the time of rotation of a conveying unit) of the conveying unit in a color printer according to the present embodiment.
Figure 12:
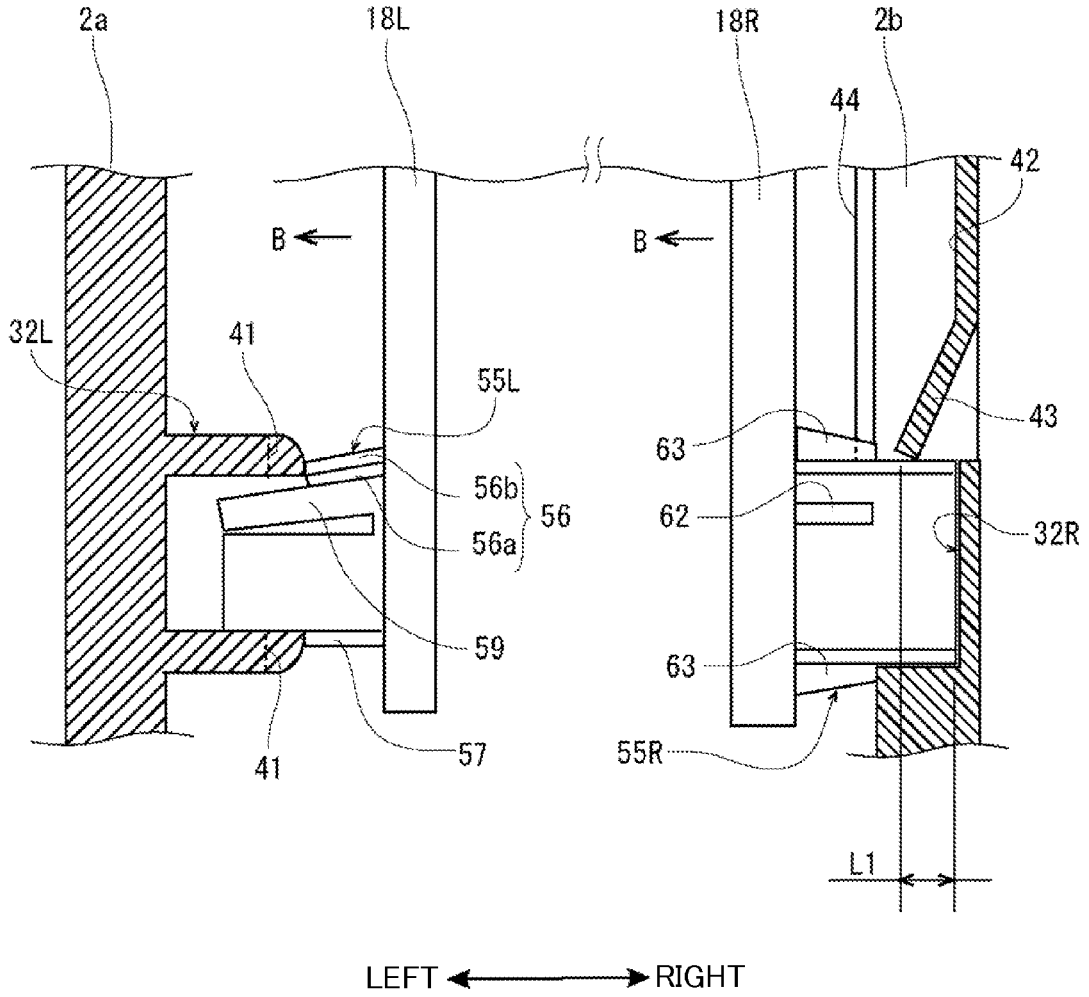
FIG. 12 is a view schematically illustrating a detachment process (at the time of deformation of an elastic piece of a left spindle) of a conveying unit in a color printer according to the present embodiment.
Figure 13:
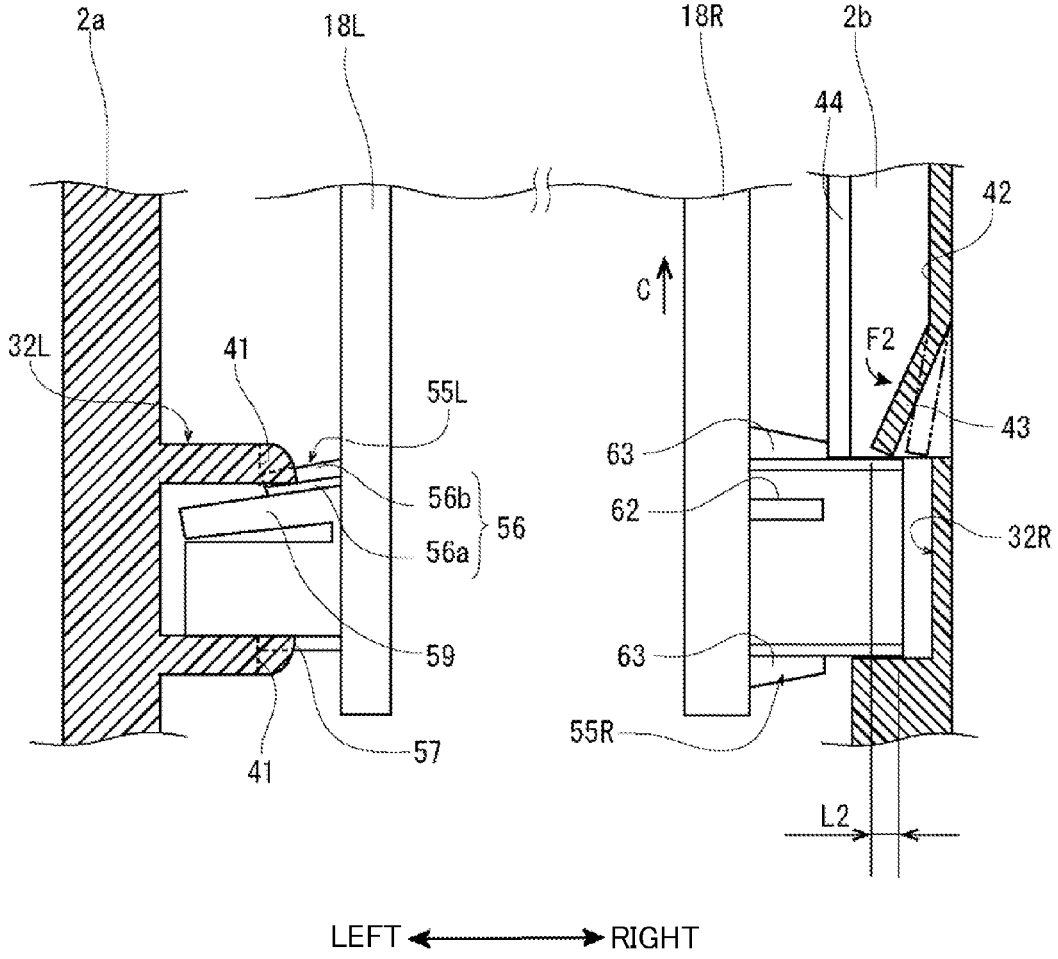
FIG. 13 is a view schematically illustrating a detachment process (at the time of sliding of a conveying unit) of the conveying unit in a color printer according to the present embodiment.
Figure 14:
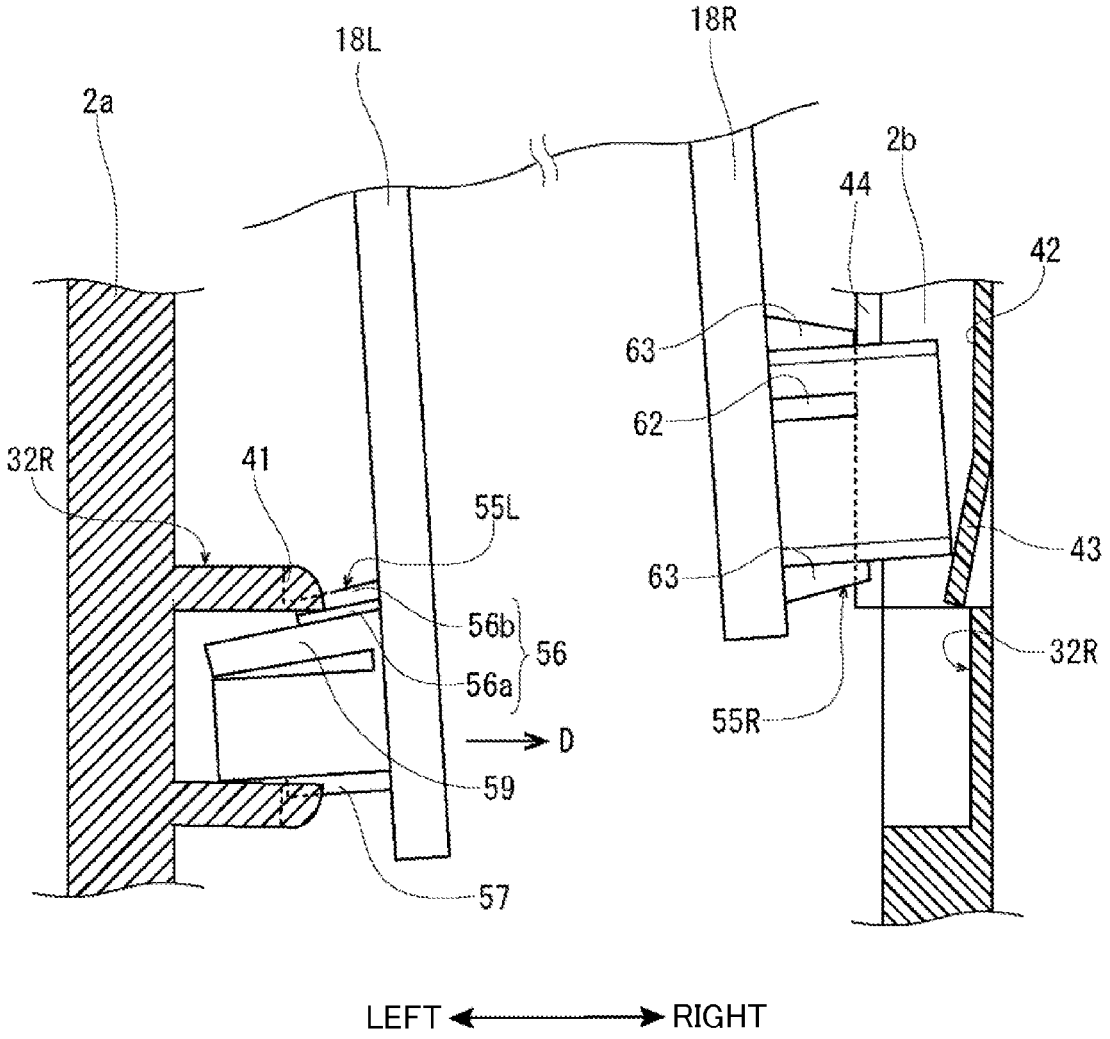
FIG. 14 is a view schematically illustrating a detachment process (at the time of sliding of a right spindle) of a conveying unit in a color printer according to the present embodiment.
Figure 15:
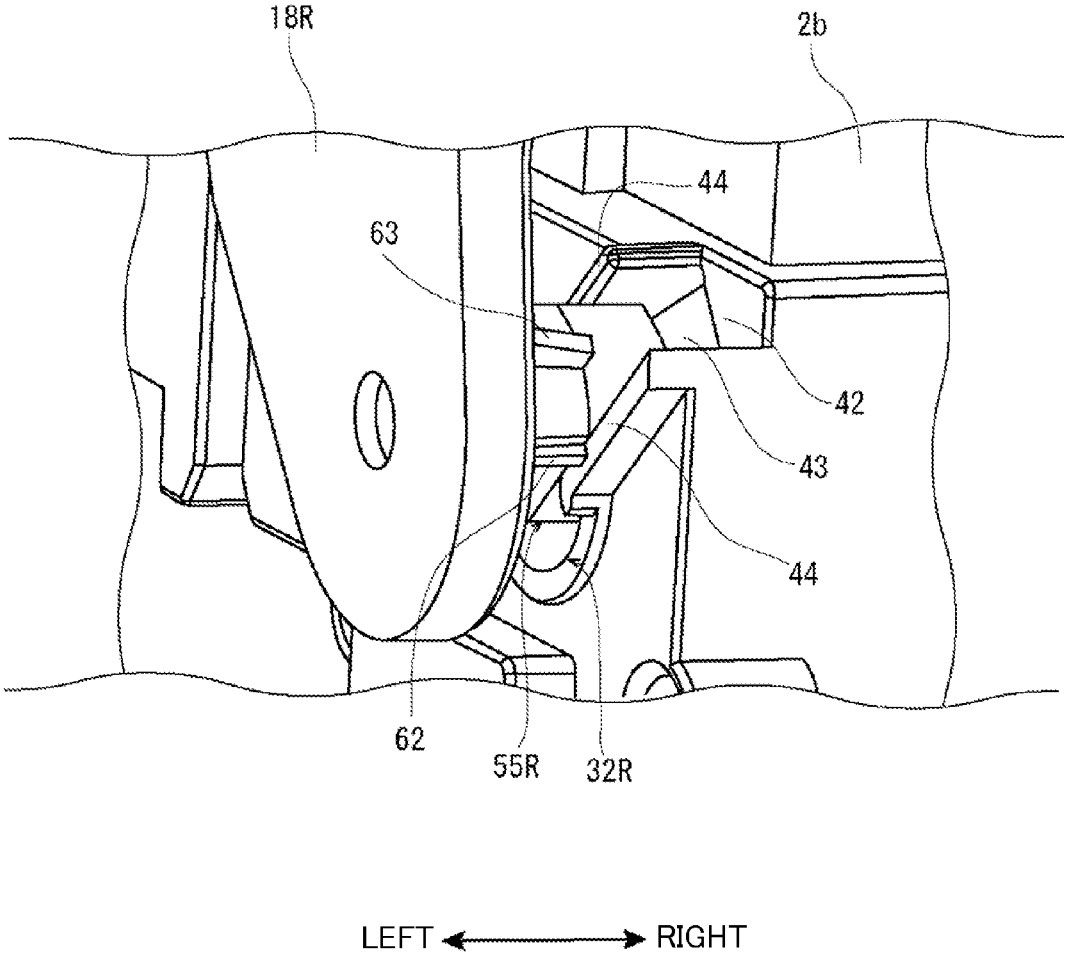
FIG. 15 is a perspective view illustrating a right spindle at the time of detachment of a conveying unit in a color printer according to the present embodiment.

Next, attachment and detachment work of the conveying unit 18 will be described with reference to FIG. 11 to FIG. 15 and the like. FIG. 11 to FIG. 14 are schematic views explaining a detachment process of the conveying unit, wherein FIG. 11 illustrates the time of rotation of the conveying unit, FIG. 12 illustrates the time of deformation of the elastic piece of the left spindle, FIG. 13 illustrates the time of sliding of the conveying unit, and FIG. 14 illustrates the time of sliding of the right spindle. FIG. 15 is a perspective view illustrating the state in which the right spindle of the conveying unit is detached. When the conveying unit 18 is detached, after the outer cover 17 and the conveying unit 18 are rotated to the opened position, the engagement of the outer cover 17 and the conveying unit 18 is released, and the conveying unit 18 is rotated to an attachment and detachment position.

When the conveying unit 18 is rotated to the attachment and detachment position, the first engaging protrusion 56 and the second engaging protrusion 57 respectively correspond to the slits 41 of the left bearing 32L in the left spindle 55L as illustrated in FIG. 11. At this time, the end surface of the pedestal portion 56*a* of the first engaging protrusion 56 abuts on the end surface of the left bearing 31L. On the other hand, in the right spindle 55R, the right spindle 55R and the rail part 42 of the right bearing 32R are linearly arranged in the longitudinal direction. At this time, since the stopper piece 43 is engaged with a portion fitted into the right bearing 32R, movement to the rail part 42 from the right bearing 32R is prevented. In this state, an engagement amount of the right spindle 55R and the stopper piece 43 in the height direction of the right spindle 55R is set to L1.

Next, in the left spindle 55L, the elastic piece 59 of the left spindle 55L is deformed inward (see an arrow F1 of FIG. 11) by using a tool such as a driver. In this way, as illustrated in FIG. 12, the pedestal portion 56*a* of the first engaging protrusion 56 is separated from the end surface of the left bearing 32L, and the engaging portion 56*b* of the first engaging protrusion 56 is fitted into the slit 41. Simultaneously, the second engaging protrusion 57 is also fitted into the slit 41. In this way, the left spindle 55L becomes slidable in the left direction (see an arrow B of FIG. 12) by the length of the slit 41. That is, the conveying unit becomes slidable while directing the axial direction leftward.

When the engaging portion 56*b* of the first engaging protrusion 56 and the second engaging protrusion 57 of the left spindle 55L are respectively fitted into the slits 41 and the conveying unit 18 slides leftward, the right spindle 55R is slightly released from the right bearing 32R as illustrated in FIG. 13. In this state, a height L2, at which the right spindle 55R and the stopper piece 43 overlap each other in the height direction of the right spindle 55R, is lower than a height L1 at which the right spindle 55R and the stopper piece 43 overlap each other before the conveying unit 18 is slided as illustrated in FIG. 11 or FIG. 12. In this state, when the stopper piece 43 is depressed rightward by using a tool such as a driver (see an arrow F2 of FIG. 13), the stopper piece 43 rotates about a side of a start point side (see a two dot chain line of FIG. 13) and is elastically deformable until it is separated from the distal end of the right spindle 55R.

That is, the right spindle 55R is movable from the right bearing 32R to the rail part 42 (see an arrow C of FIG. 13). Then, as illustrated in FIG. 14, the right spindle 55R is moved from the right bearing 32R to the rail part 42, so that the stopper protrusion 62 is loaded on the wall portion 44. Then, in the state in which the stopper protrusion 62 has been loaded on the wall portion 44, the right spindle 55R is slided along the rail part 42, so that the right spindle 55R is separated from the rail part 42. As illustrated in FIG. 15, while the right spindle 55R is sliding, the stopper piece 43 is depressed by the distal end surface of the right spindle 55R. However, since the distal end surface of the right spindle 55R is separated from the bottom surface of the rail part 42 by the degree by which the stopper protrusion 62 has been loaded on the wall portion 44, force pressing the stopper piece 43 becomes small. While the right spindle 55R is sliding, since the left spindle 55L has been still fitted into the left bearing 32L, the conveying unit 18 is slightly inclined using the left spindle 55L as a pivot point as illustrated in FIG. 14. Then, the right spindle 55R is separated from the rail part 42, and then the left spindle 55L is drawn out from the left bearing 32L (see an arrow D of FIG. 14). In this way, it is possible to detach the conveying unit 18 from the housing 2.

When the conveying unit 18 is detached, a space facing the sheet feeding unit 21 is formed in front of the outer cover 17. Through this space, it is possible to perform the exchange or maintenance of each roller of the sheet feeding unit 21.

In the case of mounting the conveying unit 18, in the left spindle 55L, the first engaging protrusion 56 and the second engaging protrusion 57 are first allowed to respectively correspond to the slits 41 of the left bearing 32L, so that the further distal end portion of the left spindle 55L than the engaging protrusions 56 and 57 of the left spindle 55L, is allowed to be fitted into the left bearing 32L. Then, the elastic piece 59 of the left spindle 55L is allowed to be deformed inward, so that the engaging portion 56*b* of the first engaging protrusion 56 is fitted into the slit 41 and the second engaging protrusion 57 is also fitted into the slit 41. That is, the state in which the conveying unit 18 has slidden leftward is obtained.

Then, the right spindle 55R is fitted into the rail part 42. At this time, an end surface of the stopper protrusion 62 of the right spindle 55R abuts on an end surface of the wall portion 44, so that only a further distal end portion, than the stopper protrusion 62 of the right spindle 55R, is fitted into the rail part 42, and the stopper piece 43 is depressed (see FIG. 14). Still in this state, the right spindle 55R is allowed to slide along the rail part 42 in the direction of the right bearing 32R. When the right spindle 55R reaches the right bearing 32R (see FIG. 13), the stopper piece 43 returns to the original inclined posture about a side of an entrance side.

Next, when the conveying unit 18 is allowed to slide rightward and a further distal end portion than the stopper protrusion 62 of the right spindle 55R, is allowed to be fitted into the right bearing 32R (see FIG. 12), each of the first engaging protrusion 56 and the second engaging protrusion 57 is released from the slit 41 in the left spindle 55L. In this way, the elastic piece 59 of the right spindle 55R is elastically deformed to the original posture, and the end surfaces of the pedestal portion 56*a* of the first engaging protrusion 56 and the second engaging protrusion 57 abut on the end surface of the left bearing 31L, so that the further distal end portion, than the first engaging protrusion 56 and the second engaging protrusion 57, is fitted into the left bearing 31L (see FIG. 11).

In accordance with the color printer 1 according to the present embodiment as described above, in the opened state of the outer cover 17 and the conveying unit 18, it is possible to detach only the conveying unit 18 without detaching the outer cover 17. In this way, since a space of the sheet feeding unit 21 in the rear upper direction is opened, it is possible to perform the exchange or maintenance of each roller of the sheet feeding unit 21 within the space with no large obstacle, resulting in the improvement of work efficiency.

Furthermore, at a predetermined position at which the conveying unit 18 has rotated in a slightly closed direction from the opened position, since it is possible to detach the conveying unit 18 by sliding the conveying unit 18 in an axial direction of a rotating shaft thereof, it does not interfere with the outer cover 17 of the opened position. Moreover, in the case of detaching the conveying unit 18, since it is necessary to perform predetermined work by using a predetermined tool, only a service man having grasped the work can perform the attachment and detachment work of the conveying unit 18. Consequently, it is possible to avoid the situation in which a general user erroneously detaches the conveying unit 18.

Moreover, in the attachment and detachment of the conveying unit 18, since it is not necessary to use other parts (a washer and the like) other than a tool (a driver and the like) for elastically deforming the elastic piece 59 and the stopper piece 43, it is possible to simplify the attachment and detachment work. In addition, since the stopper piece 43 elastically deforming is provided to the right bearing 32R of the housing 2, it is also considered that the stopper piece 43 is broken due to the insufficiency of strength thereof. Therefore, the stopper protrusion 62 is provided to the right spindle 55R pivotally supported to the right bearing 32R, the wall portion 44 vertically installed in the axial direction is further provided to the rail part 42, and the stopper protrusion 62 is allowed to engage with the wall portion 44, so that a deformation degree of elastic deformation of the stopper piece 43 becomes small when separating the right spindle 55R from the right bearing 32R and allowing the right spindle 55R to pass through the rail part 42, resulting in the improvement of the durability of the stopper piece 43.

Moreover, the present embodiment has described the case in which the configuration of the present disclosure has been applied to the color printer 1. However, in other embodiments, the present disclosure may also applied to an image forming apparatus other than the color printer 1 such as a copy machine, a facsimile, and a multifunctional peripheral.

Moreover, in the description of the aforementioned embodiment, a preferred embodiment in the image forming apparatus of the present disclosure has been described. Therefore, there is a case in which technically preferable various limitations are added to the embodiment. However, the technical scope of the present disclosure is not limited to the embodiment unless otherwise specifically limited. That is, the elements in the aforementioned embodiment can be appropriately replaced with existing elements and the like, various variations including a combination with other existing elements are possible, and the description of the aforementioned embodiment is not intended to limit the contents described in the appended claims.

What is claimed is:

1. An image forming apparatus comprising:

a cover provided to be able to open and close an opening formed in a housing;

a conveying unit disposed adjacent to an inner side of the cover and forming a sheet conveyance path in the housing; and a sheet feeding unit disposed in an inner side of the conveying unit and that feeds a sheet toward the conveyance path, wherein the cover is rotatably supported by a pair of first bearings between an opened position and a closed position of the opening, and the conveying unit is rotatably supported by a pair of second bearings, which are provided inward from the first bearings, in the same direction as a rotation direction of the cover, and is detachably provided with respect to the housing at a position at which the conveying unit has rotated in an opening direction of the cover by a predetermined angle, the conveying unit has a pair of second spindles pivotally supported by the second bearings, respectively, one of the second bearings by which one of the second spindles is pivotally supported is provided with an elastically deformable stopper piece, the elastically deformable stopper piece engaging with the one of the second spindles to prevent separation of the one of the second spindles from the one of the second bearings, the other of the second bearings by which the other of the second spindles is pivotally supported is provided with a slit, the slit extending in an axial direction of the other of the second bearings, the other of the second spindles is provided with an elastic piece having an engagement portion engageable with the slit by elastic deformation, and the elastic piece is elastically deformable to allow the engagement portion to engage with the slit, so that the conveying unit slides in the axial direction of the other of the second bearings up to a position in which engagement of the one of the second spindles and the stopper piece is releasable by elastic deformation of the stopper piece.

2. The image forming apparatus of claim 1, wherein the one of the second bearings is provided with a rail part, through which the one of the second spindles separated from the one of the second bearings slides, the stopper piece is formed in the rail part and is depressed in an axial direction of the one of the second spindles by the one of the second spindles sliding along the rail part, the one of the second spindles is provided with a stopper protrusion, the stopped protrusion extending in the axial direction of the one of the second spindles, the rail part is provided with a wall portion, which is abutted on the stopper protrusion in the axial direction of the one of the second spindles, and when the one of the second bearings slides along the rail part, the stopper protrusion abuts on the wall portion, so that a deformation degree of the elastic deformation of the stopper piece is restrained.

* * * * *